US006532963B2

(12) United States Patent
Swanbeck

(10) Patent No.: US 6,532,963 B2
(45) Date of Patent: Mar. 18, 2003

(54) THUMB PROTECTOR AND METHOD THEREFOR

(76) Inventor: Terry L. Swanbeck, 7733 Prairie Corners Dr., Las Vegas, NV (US) 89128

( * ) Notice: Subject to any disclaimer, the term of this patent is extended or adjusted under 35 U.S.C. 154(b) by 0 days.

(21) Appl. No.: 09/922,081

(22) Filed: Aug. 6, 2001

(65) Prior Publication Data

US 2003/0024535 A1 Feb. 6, 2003

(51) Int. Cl.[7] ..... A61F 5/37; A61F 5/00
(52) U.S. Cl. ..... 128/880; 602/22
(58) Field of Search ..... 128/880, 878, 128/856; 2/16, 21, 163; 24/31 F, 31 V; 602/22, 21

(56) References Cited

U.S. PATENT DOCUMENTS 1,733,933 A * 10/1929 Beltz ..... 128/880
1,800,755 A * 4/1931 Roberts et al. ..... 128/880
4,858,245 A * 8/1989 Sullivan et al. ..... 2/21
5,186,189 A * 2/1993 Harris ..... 132/285
5,450,626 A * 9/1995 Sorrels ..... 2/21
5,497,510 A * 3/1996 Knowles et al. ..... 2/21
5,761,743 A * 6/1998 Andrew et al. ..... 2/21
5,898,936 A * 5/1999 Janes ..... 2/16
6,012,165 A * 1/2000 Cain ..... 2/21

* cited by examiner

*Primary Examiner*—Nicholas D. Lucchesi
*Assistant Examiner*—Fenn Mathew
(74) *Attorney, Agent, or Firm*—Craig R. Weiss; Harry M. Weiss; Weiss, Moy & Harris, P.C.

(57) ABSTRACT

A thumb protector for the hand of a person and method therefor, comprising a base sleeve coupled with a connector to a tip sleeve and adapted to be fitted over the thumb of a person to protect the thumb from trauma that may occur when struck by a hammer.

5 Claims, 1 Drawing Sheet

THUMB PROTECTOR AND METHOD THEREFOR

FIELD OF THE INVENTION

This invention relates generally to protective devices and, more specifically, to a thumb protector for protecting the thumb of a person's hand from trauma that may occur during dangerous activity, such as hammering or drilling.

BACKGROUND OF THE INVENTION

When using a hammer, it is often necessary to hold a nail in place at the initial stage of hammering. Holding the nail in place and keeping it steady often requires gripping the nail between the thumb and the index finger. During this initial stage of hammering, when the nail is not completely secure in place, the hammer can glance off of the unsteady nail and strike the thumb or index finger. This can cause serious injury and, of course, be very painful. To combat with less force when holding the nail in place. Work gloves are often made of leather, however, and therefore generally only protect the wearer from extremely light trauma. Although somewhat deadening the blow, work gloves will not prevent the injury to a thumb that can result from being struck by a hammer. Trying to hammer with less force is also not a complete solution since it is often necessary to use a substantial amount of force to initially drive the nail into a surface. Additionally, a hammer, even one swung at less than full force, is capable of causing injury if it strikes the thumb.

A need therefore existed for a thumb protector capable of being fitted over a thumb of a person and dimensioned to be sufficiently sturdy so as to protect the thumb from sustaining trauma when struck by a hammer while at the same time allowing the thumb the flexibility to bend at the joint.

SUMMARY OF THE INVENTION

An object of the present invention is to provide a thumb protector capable of fitting over a thumb of a person and dimensioned to be sufficiently sturdy so as to protect a thumb of a person from being injured by a blow of a hammer.

It is a further object of the present invention to provide a thumb protector capable of fitting over thumbs of various lengths.

BRIEF DESCRIPTION OF THE PREFERRED EMBODIMENTS

In accordance with one embodiment of the present invention, a thumb protector is disclosed, comprising, in combination, a base sleeve having an open front portion and an open rear portion and adapted to be fitted over a proximal segment of a thumb of a person so that the rear portion is proximate a base area of said thumb and the front portion is proximate a joint area of the thumb, the base sleeve is sufficiently sturdy so as to prevent the proximal segment of the thumb from being injured when the base sleeve is struck by a blow from a hammer, a tip sleeve having an open front portion and an open rear portion and adapted to be fitted over a digital segment of a thumb of a person so that the rear portion is proximate the joint area of the thumb and the front portion is proximate a fingernail area of the thumb, the tip sleeve is sufficiently sturdy so as to prevent the distal segment of the thumb from being injured when the tip sleeve is struck by a blow from a hammer, and a connector having a first end and a second end and coupled at the first end to the open front portion of the base sleeve and coupled at the second end to the open rear portion of the tip sleeve and the connector is dimensioned to fit over the joint area of the thumb, the connector is dimensioned to be flexible so as to permit the joint area of the thumb to bend.

In accordance with another embodiment of the present invention, a method for protecting a thumb is disclosed, comprising, in combination, the steps of providing a base sleeve having an open front portion and an open rear portion and adapted to be fitted over a proximal segment of a thumb of a person so that the rear portion is proximate a base area of said thumb and the front portion is proximate a joint area of the thumb, the base sleeve is sufficiently sturdy so as to prevent the proximal segment of the thumb from being injured when the base sleeve is struck by a blow from a hammer, providing a tip sleeve having an open front portion and an open rear portion and adapted to be fitted over a distal segment of a thumb of a person so that the rear portion is proximate the joint area of the thumb and the front portion is proximate a fingernail area of the thumb, the tip sleeve is sufficiently sturdy so as to prevent the distal segment of the thumb from being injured when the tip sleeve is struck by a blow from a hammer, providing a connector having a first end and a second end and coupled at the first end to the open front portion of the base sleeve and coupled at the second end to the open rear portion of the tip sleeve and the connector is dimensioned to fit over a joint area of the thumb, the connector is dimensioned to be flexible so as to permit the joint area of the thumb to bend, and fitting the base sleeve over the proximal segment of the thumb so that the rear portion is proximate a base area of said thumb and the front portion is proximate a base area of said thumb and the front portion is proximate the joint area of the thumb and the tip sleeve covers the distal segment of the thumb.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Figure 1:
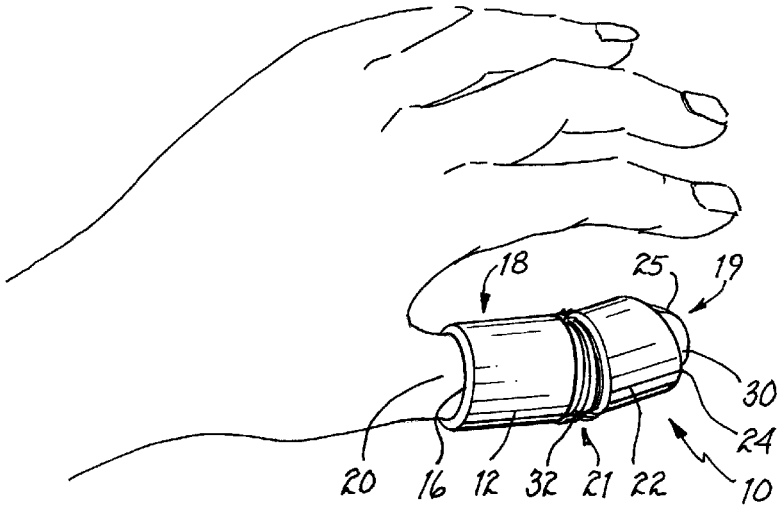
FIG. 1 is a perspective view of the preferred embodiment of the thumb protector of the present invention, showing the thumb protector fitted over a thumb of a person's hand.

Referring to FIGS. 1–4 reference number 10 refers generally to the preferred embodiment of the thumb protector of the present invention. The thumb protector 10 comprises a base sleeve 12 having an open front portion 14 and an open rear portion 16. The base sleeve 12 is adapted to be fitted over a proximal segment 18 (shown in FIG. 1) of a thumb 19 (shown in FIG. 1) so that the rear portion 16 is proximate a base area 20 of the thumb and the front portion 14 is proximate a joint area 21 (shown in FIG. 1) of the thumb 19. The base sleeve 12 is sufficiently sturdy so as to prevent the proximal segment 18 of the thumb 19 from being injured when the base sleeve 12 is struck by a blow from a hammer (not shown).

Still referring to FIGS. 1–4, the thumb protector 10 further comprises a tip sleeve 22 having an open front portion 24 and an open rear portion 26. The tip sleeve 22 is adapted to be fitted over a distal segment 28 (shown in FIG. 1) of a thumb 19 so that the rear portion 26 is proximate the joint area 22 of the thumb 19 and the front portion 24 is proximate a fingernail area 30 (shown in FIG. 1) of the thumb 19. The tip sleeve 22 is sufficiently sturdy so as to prevent the distal segment 28 of the thumb 19 from being injured when the tip sleeve 22 is struck by a blow from a hammer. In the preferred embodiment, both the tip sleeve 22 and the base sleeve 12 are formed of PVC tubing, although it should be clearly understood that substantial benefit could be derived from an alternative configuration of the thumb protector 10 in which the tip sleeve 22 and the base sleeve 12 are not formed of PVC tubing, so long as the material used is sufficiently sturdy so as to prevent injury to the thumb 19 when the thumb protector 10 is struck by a hammer.

In the preferred embodiment, the open front portion 24 of the tip sleeve 22 is cut at an angle of less than 90 degrees so as to allow an upper portion of the open front portion 24 of the tip sleeve 22 to cover the fingernail area 30 of the thumb 19 while at the same time a lower portion of the front portion 24 of the tip sleeve 22 exposes a tip of a thumb print area 25 (shown in FIG. 1) of the thumb 19. This configuration allows the tip of a person's thumb 19 to be used to grip a nail while the rest of the person's thumb 19 is still protected by the thumb protector 10. While, in the preferred embodiment, the open front protein 24 of the tip sleeve 22 is cut at an angle of less than 90 degrees it should be clearly understood that substantial benefit could be derived from an alternative configuration of the thumb protector 10 in which the open front portion 24 of the tip sleeve 22 is not cut at an angle of less than 90 degrees.

Figure 2:
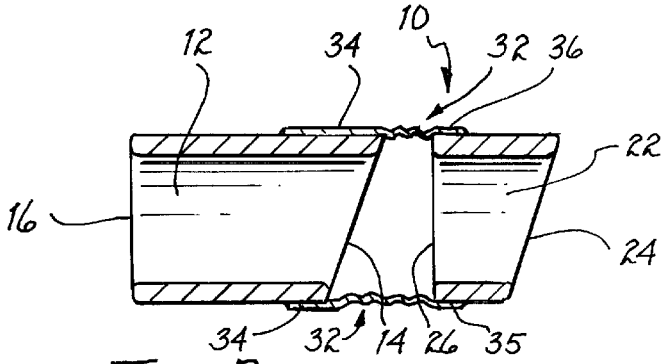
FIG. 2 is a side, cross-sectional view of the thumb protector of FIG. 1, showing the thumb protector in an extended position.
Figure 3:
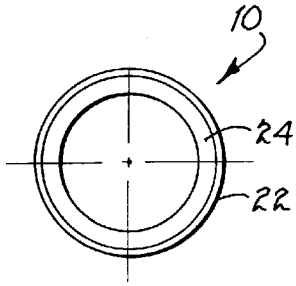
FIG. 3 is an end view of the thumb protector of FIG. 2.
Figure 4:
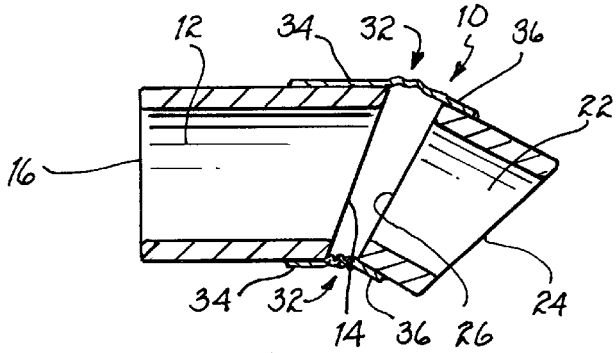
FIG. 4 is a side, cross-sectional view of the thumb protector of FIG. 1, showing the thumb protector in a bent position.

Still referring to FIGS. 1–4, the thumb protector 10 further comprises a connector 32 having a first end 34 (shown in FIGS. 2 and 4) and a second end 36 (shown in FIGS. 2 and 4). The first end 34 of the connector 32 is coupled to the open front portion 14 of the base sleeve 12 and the second end 36 of the connector 32 is coupled to the open rear portion 26 of the tip sleeve 22. The connector 32 is dimensioned to fit over the joint area 21 of the thumb 19. The connector 32 is dimensioned to be flexible so as to permit the joint area 21 of the thumb 19 to bend. In the preferred embodiment, the connector 32 is also adjustable in length so as to permit thumbs of various lengths to fit inside the thumb protector 10, although it should be clearly understood that substantial benefit could be derived from an alternative configuration of the thumb protector 10 in which the connector 32 is not adjustable in length.

In the preferred embodiment, the base sleeve 12, the tip sleeve 22 and the connector 32 form a one-piece assembly, although it should be clearly understood that substantial benefit could be derived from an alternative configuration of the thumb protector 10 in which the base sleeve 12, the tip sleeve 22, and the connector 32 are coupled to one another at a post-manufacturing stage to form the thumb protector 10.

While the invention has been particularly shown and described with reference to preferred embodiments thereof, it will be understood by these skilled in the art that the foregoing and other changes in form and details may be made therein without departing from the spirit and scope of the invention.

I claim:

1. A thumb protector comprising:

a base sleeve having an open front portion and an open rear portion and adapted to be fitted over a proximal segment of a thumb of a person so that said rear portion is proximate a base area of said thumb and said front portion is proximate a joint area of said thumb, said base sleeve is sufficiently sturdy so as to prevent said proximal segment of said thumb from being injured when said base sleeve is struck by a blow from a hammer;

a tip sleeve having an open front portion and an open rear portion and adapted to be fitted over a distal segment of a thumb of a person so that said rear portion is proximate said joint area of said thumb and said front portion is proximate a fingernail area of said thumb, said tip sleeve is sufficiently sturdy so as to prevent said distal segment of said thumb from being injured when said tip sleeve is struck by a blow from a hammer, said tip sleeve covers an entire fingernail portion of said thumb of a person; and a connector having a first end and a second end and coupled at said first end to said open front portion of said base sleeve and coupled at said second end to said open rear portion of said tip sleeve and said connector is dimensioned to fit over said joint are of said thumb, and also encircle said joint area of said thumb, said connector is dimensioned to be flexible so as to permit said joint area of said thumb to bend, said base sleeve and said tip sleeve and said connector cover substantially an entire portion of said thumb.

2. The thumb protector of claim 1 wherein said connector is adjustable in length so as to permit thumbs of various lengths to fit inside said thumb protector.

3. The thumb protector of claim 1 wherein said base sleeve and said tip sleeve and said connector form a one-piece assembly.

4. The thumb protector of claim 1 wherein said base sleeve and said tip sleeve are comprised of PVC tubing.

5. A thumb protector comprising:

a base sleeve having an open front portion and an open rear portion and adapted to be fitted over a proximal segment of a thumb of a person so that said rear portion is proximate a base area of said thumb and said front portion is proximate a joint area of said thumb, said base sleeve is sufficiently sturdy so as to prevent said proximal segment of said thumb from being injured when said base sleeve is struck by a blow from a hammer;

a tip sleeve having an open front portion and an open rear portion and adapted to be fitted over a distal segment of a thumb of a person so that said rear portion is proximate said joint area of said thumb and said front portion is proximate a fingernail area of said thumb, said tip sleeve is sufficiently sturdy so as to prevent said distal segment of said thumb from being injured when said tip sleeve is struck by a blow from a hammer, said open front portion of said tip sleeve is cut at an angle of less than 90 degrees so as to allow an upper portion of said front portion of said tip sleeve to cover said fingernail area of said thumb while at the same time a lower portion of said front portion of said tip sleeve exposes a tip of a thumb print area of said thumb; and a connector having a first end and a second end and coupled at said first end to said open front portion of said base sleeve and coupled at said second end to said open rear portion of said tip sleeve and said connector is dimensioned to fit over said joint are of said thumb, said connector is dimensioned to be flexible so as to permit said joint area of said thumb to bend.

* * * * *